United States Patent [19]

Georg

[11] 4,026,603

[45] May 31, 1977

[54] MINING INSTALLATIONS

[75] Inventor: Werner Georg, Lunen, Germany

[73] Assignee: Gewerkschaft Eisenhutte Westfalia, Wethmar near Lunen, Germany

[22] Filed: Mar. 1, 1976

[21] Appl. No.: 662,608

[30] Foreign Application Priority Data

Mar. 6, 1975 Germany ..... 2509801

[52] U.S. Cl. ..... 299/34; 198/735; 198/861; 299/43

[51] Int. Cl.[2] ..... E21C 35/20

[58] Field of Search ..... 299/32, 34, 43, 12; 198/204, 735, 861

[56] References Cited

UNITED STATES PATENTS

| | | | |
|---|---|---|---|
| 1,945,744 | 2/1934 | Levin | 198/204 |
| 3,439,508 | 4/1969 | Payne et al. | 299/12 X |
| 3,680,682 | 8/1972 | Paul | 198/204 |

FOREIGN PATENTS OR APPLICATIONS

| | | | |
|---|---|---|---|
| 1,124,543 | 8/1968 | United Kingdom | 198/204 |
| 768,559 | 2/1957 | United Kingdom | 198/204 |

*Primary Examiner*—Ernest R. Purser
*Attorney, Agent, or Firm*—Thompson, Birch, Gauthier & Samuels

[57] ABSTRACT

A mineral mining installation employs a scraper-chain conveyor with separate channel sections each with a floor plate connected between sigma-shaped side walls arranged end-to-end and a scraper-chain assembly is circulated along the channel sections to transport material. L-shaped components are attached to the side walls of the channel sections and these components define or connect with spaced-apart supports projecting beneath the lower flanges of the side walls to produce slots therewith which receive bottom plates closing off the underside of the conveyor. Tongues on these bottom plates serve as a locating and stop means engageable with the supports. A guide for a machine and for receiving the chain used to move the machine is supported by the L-shaped components on the mineral face side and a multi-part displaceable screen is carried by the L-shaped components on the opposite side.

15 Claims, 4 Drawing Figures

FIG. 2
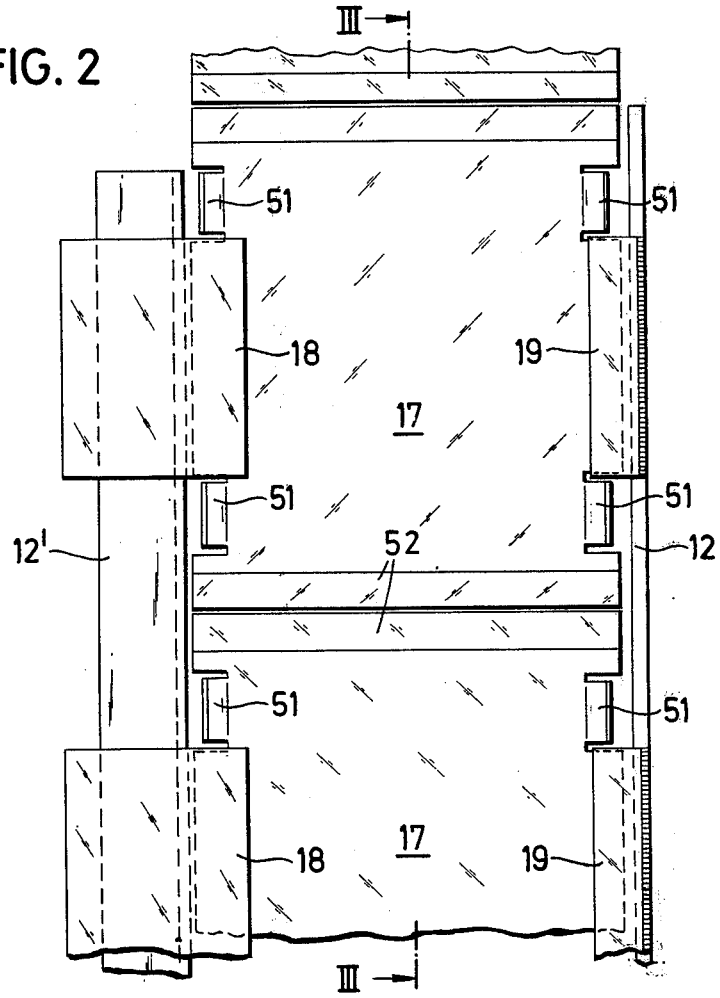
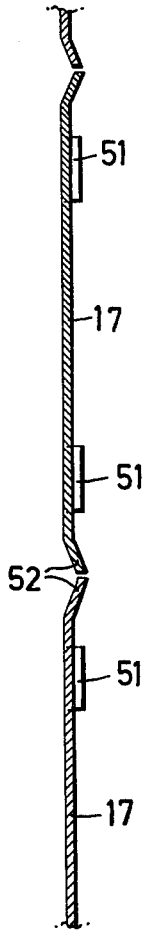
FIG. 3
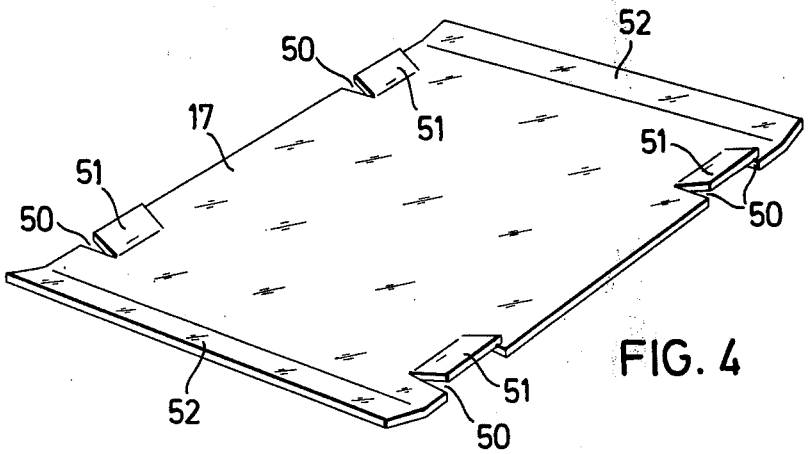
FIG. 4

MINING INSTALLATIONS

BACKGROUND TO THE INVENTION

The present invention relates in general to a mineral mining installation and to a scraper-chain conveyor usable in such an installation.

It is well known to use a scraper-chain conveyor to transport material in a mine working. Where valuable ore, such as gold, is being mined, losses during transportation should be avoided as far as possible. To this end it is known to close off the conveyor with various means to prevent such losses. A general object of the present invention is to provide an improved form of conveyor and mine installation particularly, but not soley, for the mining of valuable ores.

SUMMARY OF THE INVENTION

In one aspect the invention provides a scraper-chain conveyor for use in mining; said conveyor comprising side walls and a floor defining upper and lower passages within which a scraper-chain assembly is moved to transport material along the floor and bottom plates located in slots formed between lower surfaces of the side walls and support members secured to the side walls to close off the lower passage.

In another aspect of the invention provides a mineral mining installation comprised of a scraper-chain conveyor installed at a mineral face, a multi-part screen at the goaf side of the conveyor remote from the mineral face which serves to selectively seal off the working zone when the mineral is being won and a machine movable along the mineral face side of the conveyorto load material into the conveyor, wherein the conveyor comprises: side walls and a floor defining upper and lower passages within which a scraper-chain assembly is moved to transport material along the floor and bottom plates located in slots formed between lower surfaces of the side walls and support members secured to the side walls to close off the lower passage.

In accordance with another characteristic of the invention a number of channel sections each having side walls and a floor plate are arranged end-to-end to provide the conveyor side walls and floor and wherein each channel section has side walls which are generally sigma-shaped in cross-section with lower flanges the undersurfaces of which constitute said lower surfaces and each channel section has a plurality of said support members secured thereto.

Preferably the bottom plates, which are designed to prevent loss of transported material, are held in the mounting slots without the use of additional securing means. In one constructional form the support members are spaced apart longitudinally of the bottom plates and each bottom plate has bent-out tongues at its edge portions, which tongues project towards the floor of the mine working and away from the lower passage and form stops engageable with the support members. The tongues can serve to retain the bottom plates and aid in location of the plates. Preferably the tongues prevent lateral displacement of the bottom plates and allow a small amount of longitudinal movement. Each bottom plate may have inclined end portions which accomodate the longitudinal displacement and permit a close sealing relationship between the bottom plates to be established. The mounting arrangement for the bottom plates permits quick reliable mounting and dismounting of the plates, e.g. where it is desired to remove accumulated material thereon.

In accordance with a further feature of the invention the support members form part of components detchably secured to the side walls. These components may have portions engaging on the external lateral surfaces of the side walls and detachably secured thereto. In one constructional form each channel section is provided with two bottom plates and further plates extending over substantially the entire length of the channel section secured to the external lateral surfaces of its side walls each of said further plates having integral or attached horizontal elements which are spaced apart longitudinally of the channel sections and which constitute said support members. The portions or plates secured to the side wall adjacent to the mineral face may also serve for mounting a guide for a machine such as a loader whereas the portions or plates secured to the other goaf side wall can support the sealing screen mentioned above. Preference is given to a construction wherein the screen has resilient means permitting the height of the screen to be adjusted and wherein the screen or sections thereof can be swivelled about a horizontal axis to permit access to the mineral face.

Bolts located in the side walls can serve for the detachable connection of the portions or plates referred to. The support members at the goaf side may have continuities which engage on the floor of the mine working.

The invention may be understood more readily and various other features of the invention may become apparent from consideration of the following description.

BRIEF DESCRIPTION OF DRAWINGS

An embodiment of the invention will now be described, by way of example only, with reference to the accompanying drawings, wherein:

FIG. 2 is an inverted plan view of part of the conveyor shown in FIG. 1;

FIG. 3 is a sectional view of the conveyor part taken along the line III—III of FIG. 2; and FIG. 4 is a perspective view of one of the floor plates of the conveyor.

DESCRIPTION OF PREFERRED EMBODIMENT

Figure 1:
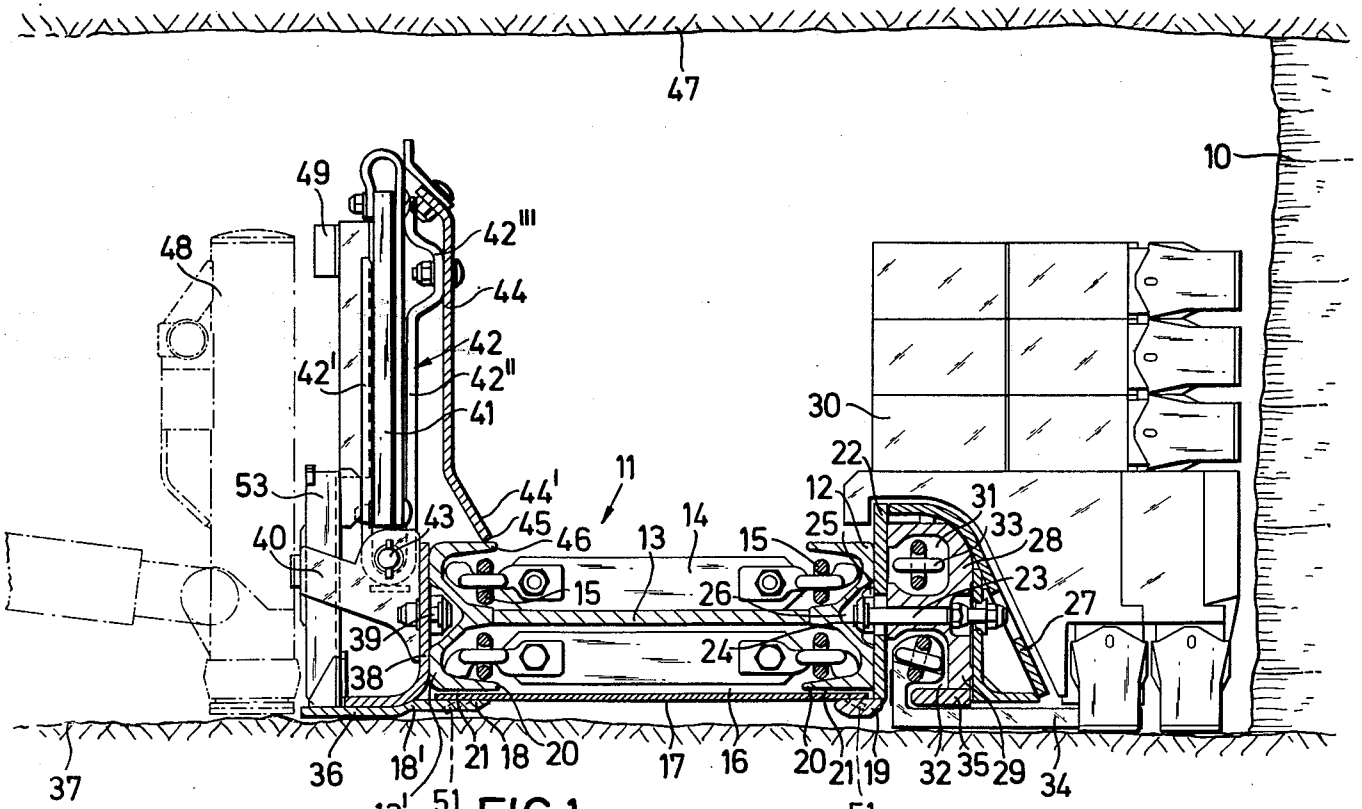
FIG. 1 is a part-schematic cross-sectional view of a mine installation employing conveying apparatus made in accordance with the invention.

As shown in FIG. 1, a scraper-chain 11 is installed in an underground mine working which has a floor 37 and a roof 47. A mineral face 10 and more usually a short-wall heading face contains mineral in the form of one or more seams or reefs which is to be won by any suitable means. The material removed from the face 10 is to be loaded and transported by the conveyor 11 in known manner. The conveyor 11, and associated equipment as illustrated, is particularly suitable for use with the winning of valuable ore such as gold where the detachment or breaking of the ore and its subsequent loading and transportation should be performed without undue loss of the ore.

In generally known manner the conveyor 11 is composed of a series of pans or trough-like channel sections arranged end-to-end. Where the face 10 is a short-wall heading the individual channel sections would be relatively short in length. The channel sections are preferably interconnected in a manner permitting a limited amount of articulation between the channel sections. Each channel sections is composed of two side walls 12,12' having a somewhat sigma-shaped cross-sectional profile rigidly interconnected, as by welding, to a horizontal floor plate 13. The floor plates 13 and side walls 12,12' of the channel sections combine to form an upper and lower passageway along which a scraper-chain assembly is moved.

This scraper-chain assembly is entrained around drums or sprockets (not shown) disposed at the ends of the conveyor and is circulated by driving one or both drums or sprockets. The upper traction run 14 of the asembley moves along the upper passageway, i.e. along the upper surfaces of the plates 13, while the lower return of the assembly moves along the lower passageway, i.e. beneath the under surfaces of the plates 13. The transport of material is effected by the upper traction run 14 of the assembly moving along the upper surfaces 13 of the plates 13. As shown in FIG. 1, the scraper-chain assembly can be of the type having two round or oval-linked chains 15 running alongside walls 12,12' with scraper elements attached between the chains 15 and spaced apart along the path of movement. The assembly can however be of the type employing one or two chains running along the central plate of the plates 13 and again attached to spaced-apart scraper elements.

The lower passageway, denoted 16, along which the lower return run of the scraper-chain assembly moves is closed off with the aid of the bottom plates 17 to prevent loss of any fine material. These plates 17 and their mounting arrangement can be appreciated from FIGS. 2 to 4. The plates 17 rest on support members 18, 19 disposed beneath the lowermost flanges 20 of the side walls 12,12' of the conveyor channel sections. As shown in FIG. 1, the members 18,19 are spaced from these flanges 20 to provide narrow gaps receiving edge portions of the plates 17. The width of these gaps is preferably only slightly greater than the thickness of the plates 17.

As shown in FIG. 2, the members 18, 19 are somewhat shorter than the plate 17 supported thereby. Each channel section is provided with two support members 18,19 on its each side and with two plates 17, with the length of each plate 17 being about half the length of the channel section. At its edge portions each plate 17 is provided with recesses 50 (FIG. 4) formed by cutting and then bending out tongues 51. These tongues 51 are spaced apart by a distance conforming with the length of the members 18, 19, as can be appreciated from FIG. 2, so that the tongues 51 engage on the ends of the members 18, 19 to provide stops for retaining the plates 17 and for aiding their location. As shown in FIGS. 3 and 4 each plate 17 is also bent at its ends to provide inclined end portions 52. The tongues 51 and the end portions 52 incline towards the floor 37 of the working when installed. This construction ensures there is virtually no gaps or spaces between adjacent plates 17 when installed and also insures that the bottom run of the scraper-chain assembly is not impeded.

The members 18, 19 form parts of individual components attached to the channel sections. As shown in FIG. 1, each of the members 19 forms a horizontal limb of a structure having an upstanding major portion 22 fixed to the outer face of the side wall 12 of one of the channel sections. The L-shaped structure providing the members 19 and the portion 22 may be an integral one-piece component or the members 19 may be fabricated separately and secured to the plate forming the portion 22, as by welding. The plates 22 are fixed to the side walls 12 with the aid of bolts 23 which have heads 24 located within the V-shaped central recesses of the walls 12 and retained by locking devices 25. The plates 22 preferably each extend over substantially the entire length of one of the channel sections so that one plate 22 with a plurality of members 19 is allocated to each channel-section. As shown in FIG. 1, shaped wear-resistant inserts 28,29 engage on the outer surfaces of the plates 22 and guide members 27 in turn engage on these inserts 28,29. The inserts 28,29 and the members 27 are clamped to the plates 22 with the aid of the bolts 23 and the bolts 23 extend through bores in the inserts 28,29. Nuts engage on the bolts 23 within recesses on the outside of the inserts 28,29 and further nuts with location washers engage in corresponding coaxial bores in the members 27. An apreture in inclined outer portions of the members 27 permit access to these nuts. The inserts 28, 29 define upper and lower chain guide passages 31, 32 and a chain 33 is circulated within these passages 31, 32 to drive a mining machine such as a plough or loader. In FIG. 1 a typical mining machine is designated 30. The machine 30 which is in the form of a body is adapted to engage on the guide members 27 which thus support and guide the machine 30 during its movement. The machine 30 has a depending tongue which engages over the upper end portions of the plates 22 and an arm 34 which projects beneath the member 27 and which extends into the lower passage 32 for connection with the chain 33. This arm 34 is formed with a guide block which runs within the passage 32 and strips or webs 35 are attached to the lower parts 29 of the inserts 28, 29 to partly closed off the passage 32. The arm 34 and its guide block extends around these strips 35 as shown in FIG. 1.

As shown also in FIG. 1, each of the members 18 forms part of a plate which has an inclined transition zone 18' joining the member 8 to a plate part 36 which rests on the floor 37 of the working. The plates having the parts 18, 18' 36 are connected, as by welding, to L-shaped plates 38 having upstanding portions secured to the side walls 12' of the channel section with the aid of bolts 38, which in a similar manner to the bolts 23, locate in the V-shaped recesses in the walls 12'. Each of these plates 38 preferably also extends substantially over the length of one of the channel sections so that each channel section has allocated to it one of the plates 38. At intervals along the plates 38 U-shaped supports 40 are provided which carry an adjustable sealing screen. This screen is composed of separate walls 41 located between U-shaped plate springs 42 permitting the height of the screen to be adjusted. The springs 42 are connected to the supports 40 with the aid of pivot pins 43 locating in the bight of the springs 42 and the arms 42'42'' of the springs 42 are biased together to grip the walls 41. The arms 42',42'' of the springs 42 thus resiliently clamp the walls 41 of the screen therebetween so that these walls 41 will be held by the springs 42 at various positions and the walls 41 are guided by the arms 42',42'' of the springs 42 during adjustment. The supports 40 can be secured to the plates 38 with the aid of the bolts 39. Locking elements 53 are attached to the screen walls 41 or to the arms 42' of the springs 42 and are engageable into shaped location recesses defined by upper parts of the supports 40. The engagement of the elements 53 with the supports 40 maintain the springs 42 and the screen walls 41 in an upright position. The elements 53 are displaceable, as by sliding, upwardly and downwardly so that they can be raised out of their retaining recesses permitting the associated screen walls 41 and springs 42 to be swivelled about the pins 43 to become parallel to the conveyor floor 13. The arm 42'' of each of the springs 42 has a U-shaped portion 42''' locating a fastener such as a nut and bolt serving to secure additional screen walls 44 to the springs 42. Each wall 44 has a lowered inclined end part 44' which extends inwardly of the conveyor channel sections to engage in sealing relationship with its lower edge 45 on the upper flange 46 of the side wall 12' of an associated channel section when the walls 41 and the springs 42 are upstanding. The walls 41 can be raised or lowered to overlap with the walls 44 and during use of the conveyor the walls 41 can be raised to contact the roof 47 of the working. In this position the screen constituted by the walls 44, 41 effectively seals off the conveyor channel sections and the working zone from the stowage or goaf zone of the heading, i.e. the left-hand side of FIG. 1. To facilitate raising and lowering of the walls 41 an extendible hydraulic device, such as a ram, shown by chain-dotted lines 48 can be provided. This device 48 is engageable with stops 49 on the screen walls 41 and can be moved from point to point to effect raising or lowering of the walls 41 in turn.

During the mineral winning operation, and especially where gold ore is being mined, the face 10 can be broken up by drilling and explosive blasting. To enable the drilling to take place the elements 53 are lifted and the walls 41, 44 swing outwardly to allow ready access to the face 10. The bore holes are then charged with explosive, the walls 41, 44 are swung upwardly and the elements 53 are relocated with the supports 40 to maintain the walls 41, 44 in an upright position. The walls 41 are then raised, for example with the device 48 to contact the roof 47. Thereafter the explosive charges are detonated and during blasting no valuable ore can be lost because the screen 44, 41 effectively shields off the blasting zone. Some of the material which is detached from the face 10 during blasting falls into the conveyor channel sections and can be transported away for further treatment. Material which falls between the mineral face side of the conveyor and the face 10 can be loaded into the conveyor channel sections by moving the machine 30 back and forth along the face. Since the screen 44, 41 is held resiliently by the springs 42 it can yeild to some extent under the effect of the shock waves arising from the blasting operation and if face material should be propelled so as to impinge on the screen 44, 41 for instance.

Although the installation as described is particularly intended for use with the mining of gold or the like it has application to the mining of other minerals especially where the face is broken up by blasting. In coal mining for instance the loader 30 can be replaced by a plough or hewing machine which cuts the coal face.

I claim:

1. In a scraper-chain conveyor for use in mining; said conveyor comprising side walls and a floor defining upper and lower passages and a scraper-chain assembly movable within the passages to transport material along the floor, support members being secured to the side walls to provide slots between the lower surfaces of the side walls and the support members, and bottom plates being located in the slots and supported by the support members to close off the lower passage, the support members forming part of components detachably secured to the side walls; the improvement comprising providing said components with portions engaging on the external lateral surfaces of the side walls and detachably thereto, said portions of the components at the mineral face side wall of the conveyor being in the form of plates to which a guide means for supporting a machine is secured.

2. A conveyor according to claim 1, wherein a number of channel sections each having side walls and a floor plate are arranged end-to-end to provide the conveyor side walls and floor, and wherein each channel section has side walls which are generally sigma-shaped in cross-section with lower flanges, the undersurfaces of which constitute said lower surfaces, and each channel section has a plurality of said support members secured thereto.

3. A conveyor according to claim 2, wherein each channel secion is provided with two bottom plates and further plates extending over substantially the entire length of the channel section secured to the external lateral surfaces of its side walls, each of said further plates having integral or attached horizontal elements which are spaced apart longitudinally of the channel section and which constitute said support members.

4. A conveyor according to claim 1, wherein the support members are spaced apart longitudinally of the bottom plate and each bottom plate has bent-out tongues at its edge portions, which tongues project towards the floor of the mine working and away from the lower passage and form stops engageable with the support members.

5. A conveyor according to claim 4, wherein each support member locates between two of the tongues.

6. A conveyor according to claim 1, wherein said plates at the mineral face side wall of the conveyor also support a means for defining guide passages along which a chain serving to drive said machine is moved.

7. A conveyor according to claim 1, wherein the support members at the goaf side wall remote from the mineral face has continuities which engage on the floor of the mine working.

8. A conveyor according to claim 1, wherein the components at the mineral face side wall of the conveyor are L-shaped in cross-section with upstanding portions constituting said plates engaging on the external lateral surface of the mineral face side walland with horizontal limbs constituting the support members.

9. In a scraper-chain conveyor for use in mining; said conveyor comprising side walls and a floor defining upper and lower passages and a scraper-chain assembly movable within the passages to transport material along the floor, support members being secured to the side walls to provide slots between lower surfaces of the side walls and the support members, and bottom plates being located in the slots and supported by the support members to close off the lower passage, the support members forming part of the components detachably secured to the side walls; the improvement comprising providing said components with portions engaging on the external lateral surfaces of the side walls and detachably secured thereto, said portions of the components at the goaf side wall of the conveyor remote from the mineral face being in the form of plates which support a multi-part sealing screen capable of screening off the goaf zone.

10. A conveyor according to claim 9, wherein a number of channel sections each having side walls and a floor plate are arranged end-to-end to provide the conveyor side walls and floor and wherein each channel section has side walls which are generally sigma-shaped in cross-section with lower flanges, the undersurfaces of which constitute said lower surfaces, and each channel section has a plurality of said support members secured thereto.

11. A conveyor according to claim 10, wherein each channel section is provided with two bottom plates and further plates extending over substantially the entire length of the channel section to the the external lateral surfaces of its side walls, each of said further plates having integral or attached horizontal elements which are spaced apart longitudinally of the channel section and which constitute said support members.

12. A conveyor according to claim 9, wherein the support members are spaced apart longitudinally of the bottom plate and each bottom plate has bent-out tongues at its edge potions, which tongues project towards the floor of the mine working away from the lower passage and form stops engageable with the support members.

13. A conveyor according to claim 12, wherein each support member locates between two of the tongues.

14. A conveyor according to claim 9, wherein the components at the goaf side wall of the conveyor comprise L-shaped elements with upstanding portions constituting said plates supporting the screen and horizontal portions to which are secured strips providing the support members.

15. A conveyor according to claim 9, wherein the screen has resilient means permitting the height of the screen to be adjusted and wherein the screen or sections thereof can be swivelled about a horizontal axis to permit access to the mineral face.

* * * * *